US007121340B2

(12) United States Patent
Grove et al.

(10) Patent No.: US 7,121,340 B2
(45) Date of Patent: Oct. 17, 2006

(54) METHOD AND APPARATUS FOR REDUCING PRESSURE IN A PERFORATING GUN

(75) Inventors: Brenden M. Grove, Missouri City, TX (US); Lawrence A. Behrmann, Houston, TX (US); Ian C. Walton, Sugar Land, TX (US); Philip Kneisl, Pearland, TX (US); Andrew T. Werner, East Bernard, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 238 days.

(21) Appl. No.: 10/709,250

(22) Filed: Apr. 23, 2004

(65) Prior Publication Data

US 2005/0236183 A1 Oct. 27, 2005

(51) Int. Cl.
*E21B 43/116* (2006.01)
*E21B 43/119* (2006.01)

(52) U.S. Cl. ..... 166/297; 166/55; 166/63; 175/2; 102/704

(58) Field of Classification Search ..... 166/297, 166/55, 55.2, 63; 175/2; 102/704
See application file for complete search history.

(56) References Cited

U.S. PATENT DOCUMENTS 2,139,104 A * 12/1938 Wells ..... 175/4.54
3,709,294 A * 1/1973 Kilgore ..... 166/243
4,800,958 A * 1/1989 Haugen et al. ..... 166/55.1
5,044,388 A * 9/1991 Barton et al. ..... 137/15.08

(Continued)

FOREIGN PATENT DOCUMENTS

GB 2242009 A 9/1991

OTHER PUBLICATIONS

Folse, K., Allin, M., Chow, C., and Hardesty, J.; "Perforating System Selection for Optimum Well Inflow Performance"; SPE 73762 paper presented at the Internal Symposium of Formation Damage; Lafayette, LA; Feb. 20-21, 2002.

(Continued)

*Primary Examiner*—David Bagnell
*Assistant Examiner*—Shane Bomar
(74) *Attorney, Agent, or Firm*—Winstead Sechrest & Minick P.C.; Bryan P. Galloway; Jaime A. Castano

(57) ABSTRACT

An apparatus for reducing the post-detonation pressure of a perforating gun, the apparatus including a perforating gun carrying at least one explosive charge, wherein when the explosive charge is detonated the explosive charge produces a pressurized detonation gas, and a mechanism for reducing the pressure of the detonation gas proximate the perforating gun. The detonation gas pressure is desirably reduced in a time frame sufficient to create a dynamic underbalance condition to facilitate a surge flow of fluid from a reservoir into a wellbore. The pressure reduction mechanism may include singularly or in combination a heat sink to reduce the temperature of the detonation gas, a reactant to recombine with the reactant gas and reduce the molar density of the detonation gas, and a physical compression mechanism to utilize the waste energy of the detonation gas to create work, simultaneously reducing the temperature of the gas and the molar density of the detonation gas.

39 Claims, 4 Drawing Sheets

U.S. PATENT DOCUMENTS

| | | | | |
|---|---|---|---|---|
| 5,088,557 | A * | 2/1992 | Ricles et al. | 166/297 |
| 5,117,911 | A * | 6/1992 | Navarette et al. | 166/299 |
| 5,188,191 | A * | 2/1993 | Tomek | 175/321 |
| 5,445,078 | A * | 8/1995 | Marion | 102/505 |
| 6,336,408 | B1 * | 1/2002 | Parrott et al. | 102/312 |
| 6,412,614 | B1 | 7/2002 | Lagrange | |
| 6,588,508 | B1 * | 7/2003 | Parrott et al. | 166/297 |
| 6,604,818 | B1 * | 8/2003 | Leibman et al. | 347/86 |
| 6,732,798 | B1 * | 5/2004 | Johnson et al. | 166/297 |
| 2003/0089498 | A1 | 5/2003 | Johnson et al. | |
| 2004/0168805 | A1 * | 9/2004 | Fripp et al. | 166/297 |

OTHER PUBLICATIONS

Johnson, A. B., Walton, I. C., and Atwood, D.C.; "Wellbore Dynamics While Perforating and Formation Interaction"; SLB Internal Report #PDF01-03; Apr. 1, 2001.

Walton, I. C., Johnson, A. B., Behrmann, L. A., and Atwood, D. C.; "Laboratory Experiments Provide New Insights into Underbalanced Perforating"; SPE 71642 paper presented at the Annual Technical Conference, New Orleans, LA; Sep. 30-Oct. 3, 2001.

* cited by examiner

METHOD AND APPARATUS FOR REDUCING PRESSURE IN A PERFORATING GUN

BACKGROUND OF INVENTION

The present invention relates in general to improving fluid communication between a reservoir formation and a wellbore and more specifically to reducing gas pressure in the perforating gun during perforating operations.

Perforating is a reservoir completion operation that provides fluid communication between a subterranean geological formation and a wellbore, which in turn connects the reservoir to the earth's surface. The goal is to facilitate controlled flow of the fluids between the reservoir formation and the wellbore.

Perforating operations are accomplished by running a perforating gun string down into the wellbore proximate the desired reservoir formation and firing of explosive charges. The explosive charges deposit significant energy into the reservoir formation within microseconds.

While successfully connecting the reservoir to the wellbore, the perforating event can be detrimental to the formation's localized pore structure (permeability) and, hence, the productivity of the formation. The damage to this shock region is typically mitigated by surge flow, wherein the damaged rock is quickly "sucked" into the wellbore. The surge flow is operationally achieved by underbalanced perforating, wherein the wellbore pressure is less than the reservoir pressure.

However, underbalance perforating is not always effective. It has recently been determined that one of the reasons that underbalance perforating may not be effective is due to the "underbalanced environment" temporarily becoming overbalanced resulting in flow of fluid into the reservoir preventing the desired cleaning surge flow. This "dynamic overbalance" is due to the high-pressure gas that may affect the wellbore pressure. In other words, the perforating gun has been a heretofore-neglected component of the perforating environment. Accurate consideration and control of the in-gun pressure is essential for designing and performing an effective perforating operation.

Therefore, it is a desire to provide a method and system for controlling the pressure in a perforating gun during a perforating operation. It is a further desire to provide a method and system for reducing the pressure in a perforating gun post-detonation.

SUMMARY OF INVENTION

In view of the foregoing and other considerations, the present invention relates to enhancing the fluid communication between a wellbore and a formation by reducing the post-detonation pressure in a perforating gun.

It is a desire of the present invention to rapidly minimize the post-detonation pressure generated inside a perforating gun carrier. The reduction of post-detonation pressure reduces the tendency to increase the post-detonation wellbore pressure. Additionally, a sufficiently low gun pressure can produce surge of fluid flow into the gun, thus causing a wellbore that may initially be overbalanced to quickly become underbalanced. These techniques are referred to as "dynamic underbalance."

Pressure within a gas at any given time is a deterministic function of its temperature and molar density (number of gas molecules per unit volume). Therefore to reduce a gas's pressure a mechanism must be used to reduce the gas's temperature and/or molar density.

The primary source of in-gun pressure is the charge's explosive. The "useful" proportion of the explosive's chemical energy is converted into jet kinetic energy, which in turn displaces target material, hence creating the desired perforation tunnel. Additional energy is deposited into the charge's confining case in the form of kinetic energy. Lesser, but potentially significant, energy can be deposited into the liner and/or case in the form of heat due to pore collapse, shock heating, plastic strain and fracture. Residual detonation gas energy is manifested in hot, high-pressure gas, some of which can exit the gun and "pressure up" the wellbore. It is desired to minimize the pressure of this residual explosive energy or "waste energy." The waste energy does eventually dissipate via heat transfer mechanisms, but much of it remains during the time scale (tens of milliseconds) relevant to surge flow. Typically, the residual detonation gas inside a perforating gun possesses approximately 30 percent of the explosive's initial chemical energy (prior to any heat transfer). The remaining 70 percent is partitioned roughly to the liner, 30 percent, and the case, 40 percent.

For purposes of description, "energy efficiency" is defined herein as the quantity of residual (waste) energy in the detonation gas relative to the explosive's initial undetonated chemical energy. Conventional perforating charges exhibit waste energy values on the order of 30 percent. The 30 percent waste energy may be reduced slightly, to approximately 25 percent, by employing charge design changes such as increasing the case thickness, mass, strength, and/or ductility. It is a desire of the present invention to further reduce the waste energy thus reducing the in-gun post-detonation pressure.

In one embodiment of the present invention the post-detonation pressure is reduced by using a fast acting energy heat sink to rapidly cool the gas. Cooling leads directly to de-pressurizing.

In a second embodiment of the present invention, the detonation gas pressure is reduced by reducing the molar density of the gas. The molar density of the detonation gas is reduced by reacting the gaseous detonation products to form solid compounds.

Another embodiment of the present invention includes reducing post-detonation gas pressure of the gun by reducing the temperature and the molar density of the detonation gas. One method is the combination of a fast acting heat sink, such as illustrated in the first embodiment, and utilizing a reactant to reduce the molar detonation products to form solid compounds as illustrated in the second embodiment. Another method is to utilize the waste energy to perform work.

Accordingly, an apparatus for reducing the post-detonation pressure of a perforating gun is provided. The apparatus including a perforating gun carrying at least one explosive charge, wherein when the explosive charge is detonated the explosive charge produces a pressurized detonation gas, and a mechanism for reducing the pressure of the detonation gas proximate the perforating gun. The detonation gas pressure is desirably reduced in a time frame sufficient to "suck" wellbore fluid into the gun creating a dynamic underbalance condition to facilitate a surge flow of fluid from the reservoir into a wellbore.

The pressure reduction mechanism may include singularly or in combination a heat sink to reduce the temperature of the detonation gas, a reactant to recombine with the reactant gas and reduce the molar density of the detonation gas, and a physical compression mechanism to utilize the waste energy of the detonation gas to create work reducing the temperature of the gas and reduce the molar density of the detonation gas.

The foregoing has outlined the features and technical advantages of the present invention in order that the detailed description of the invention that follows may be better understood. The present invention discloses methods and apparatus for reducing the post-detonation gas pressure in a perforating gun carrier via temperature reduction and/or molar density reduction to facilitate surge flow from the formation. Additional features and advantages of the invention will be described hereinafter which form the subject of the claims of the invention.

BRIEF DESCRIPTION OF DRAWINGS

The foregoing and other features and aspects of the present invention will be best understood with reference to the following detailed description of a specific embodiment of the invention, when read in conjunction with the accompanying drawings, wherein.

DETAILED DESCRIPTION

Figure 1:
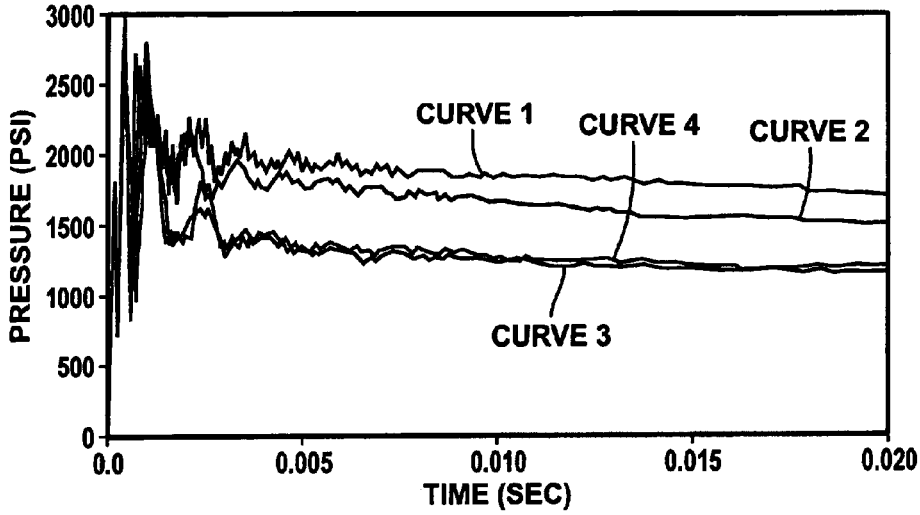
FIG. 1 is a graph of the first 20 milliseconds upon detonation of an explosive charge in a closed bomb experiment utilizing various heat sink materials.

Refer now to the drawings wherein depicted elements are not necessarily shown to scale and wherein like or similar elements are designated by the same reference numeral through the several views.

In one embodiment of the present invention the post-detonation pressure is reduced by utilizing a fast acting energy heat sink that rapidly cools the gas. Cooling leads directly to de-pressurizing. An additional benefit of cooling is the potential condensing out of any water vapor, which is well known to comprise a significant quantity of the detonation gas. Condensation reduces gas density and given sufficient heat transfer rates, will significantly lower pressure.

Effective heat sinks must possess two intrinsic properties: rapid heat absorption (high thermal conductivity), and large thermal energy storage capacity. Energy storage capacity can be manifested in specific heat capacity and/or phase change enthalpy. Example materials exhibiting high thermal conductivities, high heat capacities, and/or high phase change enthalpies include, but are not limited to, steel, copper, silver, nickel and water.

Of the metals, copper exhibits the best combination of high conductivity (rapid heat absorption) and heat capacity (quantity of heat absorbed). For this discussion all material properties are taken at standard conditions. Water possesses the greatest thermal conductivity of all common materials, conducting heat 40 percent faster than silver and 50 percent faster than pure copper. Water also possesses a very high volumetric specific heat capacity, about 23 percent higher than that of steel or copper. Additionally, water exhibits a very high heat of vaporization (2.2 kJ/g). It is this final characteristic, and the fact that in-gun gas temperatures typically exceed water's boiling point, while remaining well below the boiling point of the metals, that most significantly distinguishes water from the other materials.

In addition to these intrinsic properties, physical configuration is also important. Proximity of the heat sink to the detonation gas, exposed surface area, and total quantity of the heat sink material greatly determine the extent and rate of energy transfer. Experiments have demonstrated the efficacy of various heat sinks at quickly reducing the detonation gas pressure. Experiments were conducted in "closed bomb" experiments wherein the evolving gas pressure was recorded when a small quantity of explosive was detonated within a sealed chamber. In each experiment a different heat sink candidate was evaluated, and the measured gas pressure was used as an indicator of energy-absorbing effectiveness.

Figure 2:
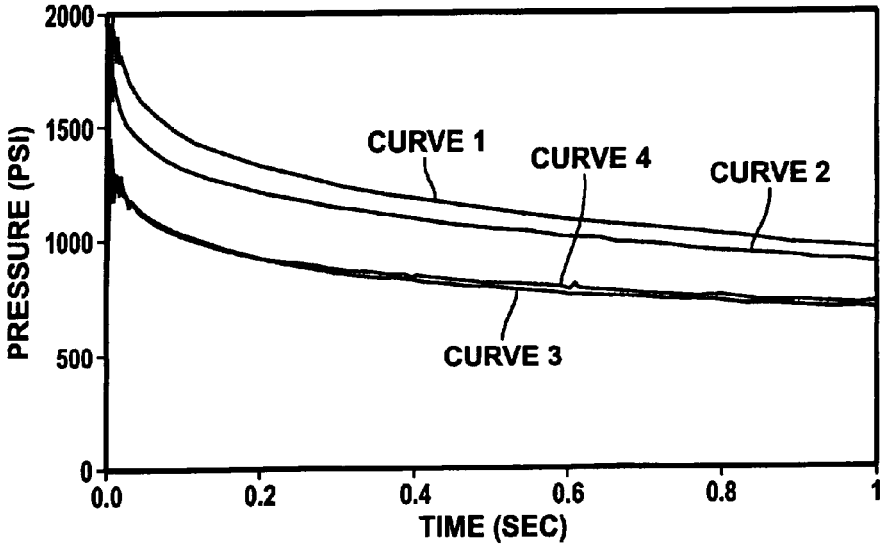
FIG. 2 is a graph of the first second upon detonation of an explosive charge in a closed bomb experiment utilizing various heat sink materials.

FIGS. 1 and 2 show pressure data from these experiments. FIG. 1 graphically shows the first 20 milliseconds upon detonation. FIG. 2 graphically shows a full second upon detonation. In each test, the explosive detonation was complete by approximately 10 microseconds, by 3 to 5 milliseconds the shock transients subsided and spatial equilibrium was reached.

With reference to FIGS. 1 and 2, four curves are shown illustrating the change in pressure over time for four separate tests.

Curve 1, the top curve, represents the results of the baseline test in which no heat sink was added. The pressure in the experiment decayed due to the "closed bomb" housing itself acting as a heat sink. This is the baseline against which the effectiveness of additional heat sinks is evaluated.

In the second experiment, a copper powder was introduced into the closed bomb chamber. Curve 2, second curve from the top, represents the pressure over time for copper powder. The copper powder effectively reduced pressure within the first 5 to 10 milliseconds after detonation.

In the third experiment, water was introduced into the closed bomb chamber. The water volume tested was identical to the total copper volume utilized in the second experiment. For the quantities in the configuration tested, water reduced gas pressure, curve 3, more effectively than copper and did so within the first 2 to 5 milliseconds.

In the fourth experiment, microencapsulated water beads were introduced into the closed bomb. The beads are essentially a fine powder wherein each powder particle is a thin plastic shell filled with water. The quantity of water contained in the powder was the same as the quantity of water used in the third experiment. The pressure over time, curve 4, is shown on top of curve 3.

Figure 3A:
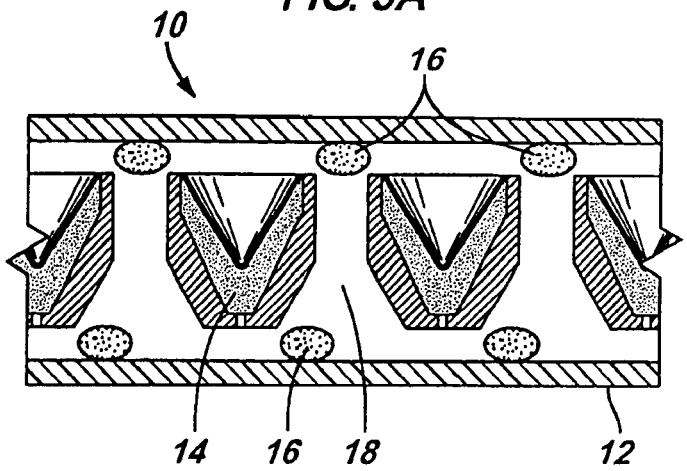
FIG. 3A is a partial, cross-sectional view of an embodiment of a perforating gun of the present invention utilizing an added heat sink.

FIG. 3A is a partial, cross-sectional view of an embodiment of a perforating gun 10 of the present invention. Perforating gun 10 includes a gun carrier 12 forming a gun chamber 18, explosive charges 14, charge carriers 14*a* and an in-gun pressure reducer. In this embodiment, the pressure reducer is a heat sink 16 disposed proximate charges 14 and within perforating gun 10 Heat sinks (temperature reducers) 16 reduce the temperature of and therefore the pressure of the detonation gas from explosive charges 14.

FIG. 3A illustrates the heat sink material 16 disposed within gun chamber 18 or connected to or embedded into charger carrier 12. It should be recognized that heat sink 16 may be formed or placed in numerous locations proximate explosive charges 14 and the resultant detonation gas (not shown, but which, substantially fills gun chamber 18). Examples, without limitation, of various locations for placement of heat sink 16 are illustrated in the various Figures.

Figure 3B:
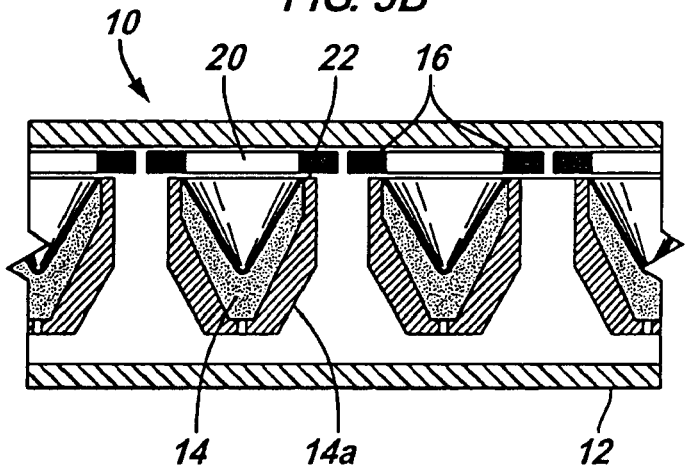
FIG. 3B is a partial, cross-sectional view of an embodiment of a perforating gun of the present invention utilizing an added heat sink.

FIG. 3B is a partial, cross-sectional view of another embodiment of a perforating gun 10 of the present invention including an added heat sink 16. In this embodiment, heat sink 16 is incorporated into a cover 20 that is positioned proximate the front face 22 of explosive charge 14.

Figure 3C:
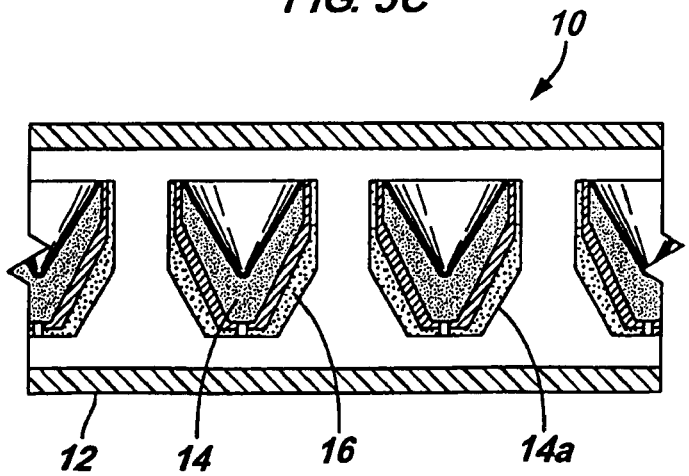
FIG. 3C is a partial, cross-sectional view of an embodiment of a perforating gun of the present invention utilizing an added heat sink.

FIG. 3C is a partial, cross-sectional view of another embodiment of a perforating gun 10 of the present invention including an added heat sink 16. In this embodiment, heat sink 16 is incorporated into charge case 14*a* of explosive charges 14.

With reference to FIGS. 3A through 3C, the heat sinks may be formed of any material having one or more of the following characteristics, high heat capacity (specific heat capacity and/or phase change enthalpy), high thermal conductivity, high surface area, high vaporization enthalpy. Heat sink 16 materials include, but are not limited to fined solids, powders, and monolithic volumes including water, copper or other appropriate materials. The heat sink 16 material may be embedded, disposed in or connected to the perforating charge case 14*a*, the gun carrier 12, gun chamber 18, the loading tube (not shown) or other portions of gun 10.

In another embodiment of the present invention the post-detonation gas pressure is reduced by a pressure reducer that reduces the molar density of the gas (molar density reducer). For purposes of this disclosure, at late times the final equilibrium gas pressure is determined by its molar density since the gas temperature will be equal to the prevailing wellbore temperature. Therefore, the only manner to reduce late-time pressure is to reduce the late-time molar density. Further, for the present embodiment, a fixed system volume is assumed, so that a reduction in molar density is synonymous with a reduction in the number of gas moles, or molecules.

For a perforating gun system having an infinitely fast heat transfer, wherein the detonation gas instantly cools to the prevailing wellbore temperature, the pressure may still be undesirably high if its molar density is high. In reality, heat transfer is finite, and the present embodiment may increase gas temperature in the short term, perhaps enough to produce a net pressure increase. However, with sufficiently rapid heat transfer the present invention effectively reduces the pressure inside the gun over the time scale of interest. The present embodiment may also be utilized in non-perforating applications to reduce late-time pressure.

In general, ideal (CHNO) explosives decompose to produce primarily the following molecular species: $N_2$, $H_2O$, $CO_2$, CO and C. All are gaseous except the carbon, which is generally solid graphite (soot). Other trace gas species exist, but these comprise the majority of the detonation product gas. For subsequent gas mole quantity calculations it is assumed that $N_2$ and $H_2O$ each comprise approximately 40 percent and $CO_2$ and CO comprise the remaining 20 percent.

The present embodiment discloses reducing quantities of the primary gaseous species by recombining the constituent atoms with other reactants producing one or more of the following classes of solid compounds (many of which are well known ceramics): nitrides; oxides; hydroxides; and hydrides. For a system of fixed volume, the present embodiment produces the result of reducing the molar density of the detonation gas.

Oxides. The following reactants form oxides more stable than CO, $CO_2$, or $H_2O$ (the most favored compound for each is indicated by parenthesis): Al ($Al_2O_3$), B ($B_{23}$), Ba (BaO), Ca (CaO), Fe ($Fe_3O_4$), K ($K_2O$), Li ($Li_2O$), Mg (MgO), Mn (MnO), Mo ($MoO_2$), Na ($Na_2O$), Si ($SiO_2$), Sn ($SnO_2$), Ta ($Ta_2O_5$), Ti (TiO), V ($V_2O_3$), W ($WO_2$), Zn (ZnO), Zr ($ZrO_2$). Reducing the CO and $CO_2$ to C(solid), would reduce the total gas molar density by approximately 20 percent.

Hydroxides and Hydrides. Several of the above elements also form hydroxides, and/or combinations thereof form oxides. Those produced by sodium and potassium are more stable than the basic oxides: $K_2B_4O_7$, KOH, $Na_2B_4O_7$, and NaOH. Other elements form hydroxides which are less stable than their oxides (but still more stable than water): Al, Ba, Ca, Fe, Li, Mg, Sn, Zn.

The following reactants form hydrides; none are more stable than $H_2O$, so their formation would have to be preceded by prior reduction to $H_2$ by other means (discussed above) (the most favored compound for each is indicated by parenthesis): Al ($AlH_3$), Ca ($CaH_2$), Li (LiH), Mg ($MgH_2$), K (KH), Na (NaH), Ta ($Ta_2H$), Ti ($TiH_2$), Zr ($ZrH_2$). Consuming all oxygen and hydrogen would reduce the total gas molar density by approximately 60 percent.

Nitrides. The following reactants form stable nitrides (the most favored compound for each is indicated by parenthesis): Al (AlN), B (BN), Ca ($Ca_3N_2$), Li ($Li_3N$), Mg ($Mg_3N_2$), Si ($Si_3N_4$), Ta (TaN), Ti (TiN), V (VN), Zr (ZrN). Consuming all nitrogen would reduce total gas molar density by approximately 40 percent.

From the above lists, we identify species which form stable nitrides, oxides, and hydroxides or hydrides; these could theoretically consume essentially all detonation product gas species: Al, Ca, Li, Mg, Ta, Ti, and Zr. The likely formed compounds are disclosed in TABLE 1.

TABLE 1

| Element | Oxide (Gibbs Free Energy: kJ/mol-O) | Hydroxide (Gibb s Free Energy: kJ/mol-O) | Hydride (Gibbs Free Energy: kJ/mol-H) | Nitride (Gibbs Free Energy: kJ/mol-N) |
|---|---|---|---|---|
| Al | $Al_2O_3$; −527 | $Al(OH)_3$; −435 | $AlH_3$; ? | AlN; −287 |
| Ca | CaO; −603 | $Ca(OH)_2$; −449 | $CaH_2$; −72 | $Ca_3N_2$; ?? |
| Li | $Li_2O$; −561 | LiOH; −439 | LiH; −68 | $Li_3N$; −129 |
| Mg | MgO; −569 | $Mg(OH)_2$; −417 | $MgH_2$; −18 | $Mg_3H_2$; −201 |

TABLE 1-continued

| Element | Oxide (Gibbs Free Energy: kJ/mol-O) | Hydroxide (Gibb s Free Energy: kJ/mol-O) | Hydride (Gibbs Free Energy: kJ/mol-H) | Nitride (Gibbs Free Energy: kJ/mol-N) |
|---|---|---|---|---|
| Ta | $Ta_2O_5$; −382 | | $Ta_2H$; −69 | TaN; ? |
| Ti | TiO; −495 | | $TiH_2$; −53 | TiN; −244 |
| Zr | $ZrO_2$; −522 | | $ZrH_2$; −65 | ZrN; −337 |

The formation enthalpy of a compound is roughly proportional to the Gibbs free energy, so the magnitude of the Gibbs function (stability) indicates the magnitude of the exotherm (and attendant short-term pressure rise). More accurately, the difference between the formation enthalpies of the product(s) and reactant(s) indicate the net exotherm. The ideal reactant 24 is one which produces a minimal exotherm, of which a small quantity is required (to minimize impact on detonation performance), and which is afforded the necessary activation energy.

Thus, the present invention includes the placement of reactants 24 in the vicinity of the detonation gas from explosive charge 14, including embedding one or more of the following reactants 24 within the undetonated explosive charge 14. Materials for reactant 24 include, but are not limited to Al, Ca, Li, Mg, Ta, Ti and Zr.

It should be recognized that the quantity of reactant 24 might vary depending on the operative kinetics, desired molar density reduction, and the desire to minimize the impact on the detonation performance. Exemplary embodiments of the present invention utilizing reactants to reduce the molar density of the detonation gas are illustrated in FIGS. 4A through 4C.

Figure 4A:
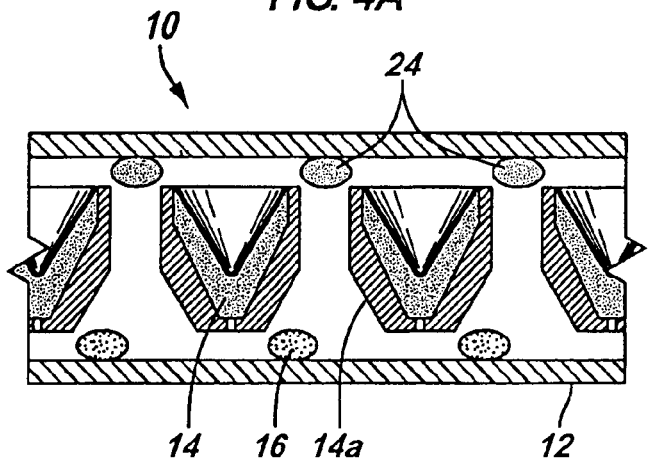
FIG. 4A is a partial, cross-sectional view of an embodiment of a perforating gun of the present invention including a reactant.

FIG. 4A is a partial, cross-sectional view of an embodiment of a perforating gun 10 of the present invention including a reactant 24 as the in-gun pressure reducer. As shown in FIG. 4A, reactant 24 is positioned proximate explosive charge 14. Reactant 24 may be positioned within chamber 18, connected to or embedded in gun carrier 12 or disposed in other locations proximate the vicinity of the detonation gas resulting from the detonation of explosive charges 14. Examples, without limitation, of various locations for placement of reactant 24 are illustrated in the various Figures.

Figure 4B:
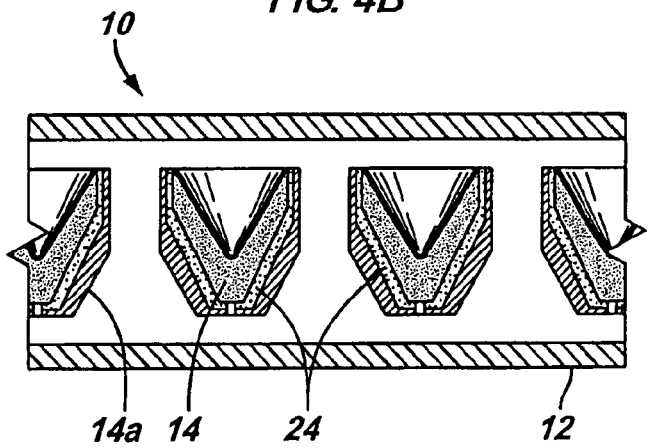
FIG. 4B is a partial, cross-sectional view of an embodiment of a perforating gun of the present invention including a reactant.

FIG. 4B is a partial, cross-sectional view of another embodiment of a perforating gun 10 of the present invention including a reactant 24. FIG. 4B illustrates reactant 24 included within casing 14*a* of explosive charge 14.

Figure 4C:
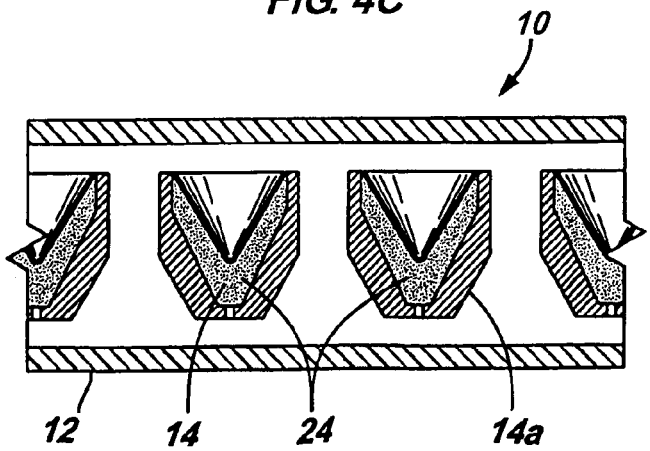
FIG. 4C is a partial, cross-sectional view of an embodiment of a perforating gun of the present invention including a reactant.

FIG. 4C is a partial, cross-sectional view of another embodiment of a perforating gun 10 of the present invention including a reactant 24. FIG. 4C illustrates reactant 24 being embedded into the explosive charge 14.

In another embodiment of the present invention, perforating gun 10 may include mechanisms for reducing both the temperature and the molar density of the post-detonation gun pressure. One example is combining features disclosed in FIGS. 3 and 4. An example is illustrated in FIG. 4A. It should be realized that heat sink material 16 and reactants 24 can be incorporated into perforating gun 10 of the present invention to reduce the post-detonation pressure of the perforation operation.

The post-detonation pressure may also be reduced by mechanical means, which heretofore have not been realized.

When an ideal gas expands isenthalpically (i.e. "throttling" the ideal example is expansion into a vacuum), the gas does no work, and possesses essentially the same energy after expansion as before. If the gas's specific heat capacity is constant, this expansion is isothermal.

From the ideal gas law, P=R*(n/V)*T, such an expansion would only reduce pressure by reducing molar density, P2=P1*(V1/V2). Here, n is constant and V changes, in contrast with the previous embodiment illustrated in FIGS. 4A, 4B and 4C.

However, when an expanding gas does work, it is giving up energy to the surroundings on which it is working. Energy conservation dictates that the expanding gas cools. When an ideal gas expands isentropically, its pressure drops as follows: P2=P1*(V1/V2)^γ, wherein γ is the adiabatic exponent (approximately 1.4 for air and many other gasses). Thus, isentropic expansion produces a more significant pressure drop than does isothermal expansion.

An effective "working" expansion need not be isentropic or even adiabatic, as other irreversible processes can occur. Indeed, such processes do occur during the initial expansion of detonation gas 26 (shock heating, plastic flow, pore collapse of the case and liner, etc.). The present invention and embodiment addresses converting the gas's potential (thermal) energy into kinetic energy via PdV (pressure applied times volume change) work. This kinetic energy may be subsequently and/or concurrently dissipated via any number of mechanisms, i.e. viscous heating, plastic strain, pore collapse, etc. Alternatively, the energy can be released back into the detonation gas after sufficient time (tens of milliseconds) has elapsed after detonation of charges 14 to realize the benefit of reduced gun pressure.

Figure 5A:
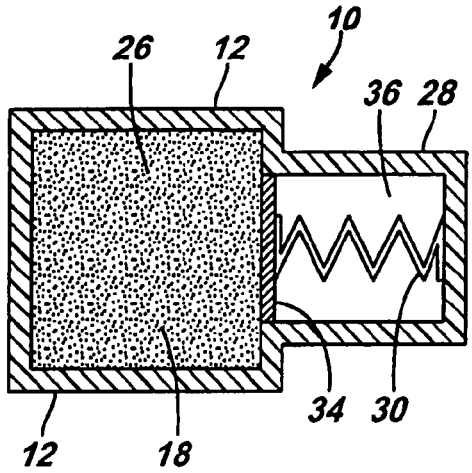
FIG. 5A is a schematic drawing of a perforating gun of the present invention including a mechanical compression section, at time 1 when an explosive charge is detonated.
Figure 5B:
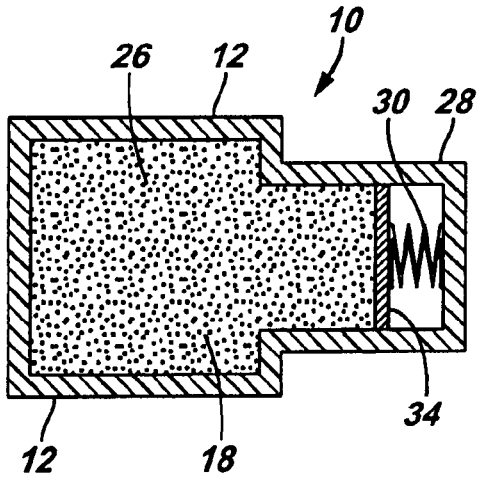
FIG. 5B is a schematic drawing of a perforating gun of the present invention including a mechanical compression section, at time 2 defined as within milliseconds after an explosive charge is detonated.

FIG. 5A is a schematic drawing of a perforating gun 10 of the present invention including a pressure reducer identified as a compression section 28. With reference to FIGS. 5A and 5B, perforating gun 10 includes a gun carrier 12 and a gun chamber 18. Gun chamber 18 is functionally connected to a compression chamber 36 defined by a compression section 28. A compression barrier 34 sealably separates gun chamber 18 and compression chamber 36. Compression barrier 34 is moveable into compression chamber 36. Compression barrier 34 may be slidably moveable and/or deformable such as a diaphragm. Compression chamber 36 includes a compressible material 30 such as a compressible gas or material such as a spring or other piston type device. Compressible material 30 must be compressible within the wellbore environment for which it subjected and compressible within milliseconds upon detonation of the explosive charges. Compressible material 20 may include a mechanical apparatus such as a spring, a compressible fluid such as a gas or liquid, or a compressible solid.

FIG. 5A illustrates perforating gun 10 at time 1 (t1), the time of, or within microseconds, of detonation of explosive charges 14 (FIGS. 3 and 4). Detonation gas 26 has filled gun chamber 18.

FIG. 5B illustrates perforating gun 10 at time 2 (t2), a time within milliseconds of detonation of the explosive charge. Detonation gas 26 has expanded working against and compressing compressible material 30, thereby expending the waste energy in detonation gas 26, reducing the molar density and temperature of detonation gas 26 and thus the pressure.

Figure 5C:
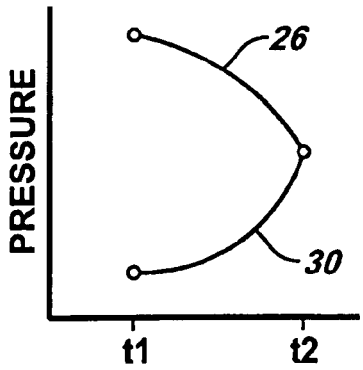
FIG. 5C is a graphical illustration of the pressure drop of the detonation gas and the increase of the pressure on the mechanical compression material from the time of detonation of the charges through several milliseconds after the detonation of the explosive charges.

FIG. 5C is a graphical illustration of the reduction of the post-detonation pressure of the detonation gas in the gun and the increase in the pressure on the compressible material during the relevant time from of "t1" and "t2."

With reference to FIGS. 1 through 5 a method of reducing post-detonation gas 26 pressure of a perforating gun 10 to facilitate surge flow is described. A perforating gun 10 is provided having explosive charges 14 and pressure reducing mechanism for reducing the pressure of the detonation gas 26 resulting from the detonation of the explosive charges 14.

The pressure reducer may include a heat sink 16 for reducing the temperature of detonation gas 16, and/or a reactant 24 for reducing the molar density of detonation gas 16, and/or a compression section 28 to cause the detonation gas to work thus reducing the temperature and increasing the volume of gun 10 to reduce the molar density.

Heat sink 16 is disposed proximate explosive charges 14. Heat sink 16 may be comprised of including, but not limited to, fined solids, powders, and monolithic volumes including water, copper or other appropriate materials.

The ideal reactant 24 is one which produces a minimal exotherm, of which a small quantity is required (to minimize impact on detonation performance), and which is afforded the necessary activation energy. Reactant 24 may comprise singularly or in combination, but is not limited to, Al, Ca, Li, Mg, Ta, Ti and Zr.

From the foregoing detailed description of specific embodiments of the invention, it should be apparent that a system for controlling the dynamic pressure transient during a perforating operation that is novel has been disclosed. Although specific embodiments of the invention have been disclosed herein in some detail, this has been done solely for the purposes of describing various features and aspects of the invention, and is not intended to be limiting with respect to the scope of the invention. For example, it should be recognized that "in-gun" pressure includes the pressure created in the gun as well as proximate the gun and references to disposed in or connected to the gun includes being a part of the perforating gun string or in functional connection with the perforating gun such that disposed in the gun includes being part of the gun carrier or forming an extension to the perforating gun. It is contemplated that various substitutions, alterations, and/or modifications, including but not limited to those implementation variations which may have been suggested herein, may be made to the disclosed embodiments without departing from the spirit and scope of the invention as defined by the appended claims which follow.

The invention claimed is:

1. An apparatus for reducing the post-detonation pressure of a perforating gun, the apparatus comprising:

the perforating gun carrying at least one explosive charge, wherein when the explosive charge is detonated the explosive charge produces a pressurized detonation gas; and a pressure reducer in functional connection with the perforating gun, the pressure reducer including a heat sink adapted for rapidly reducing temperature of the detonation gas.

2. The apparatus of claim 1 wherein the pressure reducer is positioned proximate the perforating gun.

3. The apparatus of claim 1 wherein the pressure reducer is positioned in the perforating gun.

4. The apparatus of claim 1 wherein the pressure reducer is part of the perforating gun.

5. The apparatus of claim 1 wherein the heat sink has a high thermal conductivity.

6. The apparatus of claim 1 wherein the heat sink has a large heat capacity.

7. The apparatus of claim 1 wherein the heat sink includes copper.

8. The apparatus of claim 1 wherein the beat sink includes water.

9. The apparatus of claim 1 wherein the heat sink includes microencapsulated water beads.

10. An apparatus for reducing the post-detonation pressure of a perforating gun, the apparatus comprising:

the perforating gun carrying at least one explosive charge, wherein when the explosive charge is detonated the explosive charge produces a pressurized detonation gas; and a pressure reducer in functional connection with the perforating gun, wherein the pressure reducer includes a reactant adapted for recombining with the detonation gas to reduce the molar density of the detonation gas.

11. The apparatus of claim 10 wherein in the reactant is selected from the group consisting of Al, Ca, Li, Mg, Ta, Ti, Zr, and combinations thereof.

12. The apparatus of claim 10, wherein the pressure reducer further includes a pressure compression section in functional connection with the perforating gun.

13. The apparatus of claim 12 wherein the compression section includes a compressible material.

14. The apparatus of claim 13 wherein the compressible material is a spring.

15. The apparatus of claim 13 wherein the compressible material is a solid.

16. The apparatus of claim 13 wherein the compressible material is a fluid.

17. The apparatus of claim 13 wherein the pressure reducer is positioned proximate the perforating gun.

18. The apparatus of claim 13 wherein the pressure reducer is positioned in the perforating gun.

19. The apparatus of claim 13 wherein the pressure reducer is part of the perforating gun.

20. The apparatus of claim 10 wherein the pressure reducer is positioned proximate the perforating gun.

21. The apparatus of claim 10 wherein the pressure reducer is positioned in the perforating gun.

22. The apparatus of claim 10 wherein the pressure reducer is part of the perforating gun.

23. The apparatus of claim 10, further including a heat sink adapted to rapidly reduce the temperature of the detonation gas.

24. The apparatus of claim 23, wherein the heat sink includes copper.

25. The apparatus of claim 23, wherein the heat sink includes water.

26. The apparatus of claim 23, wherein the heat sink includes microencapsulated water beads.

27. A method of reducing the post-detonation pressure of a perforating gun comprising the steps of:

providing the perforating gun with explosive charges;

providing a heat sink in functional connection with the perforating gun;

detonating the explosive charges producing a pressurized detonation gas; and reducing the detonation gas pressure proximate the perforating gun to encourage a surge flow from a reservoir formation by rapidly reducing the temperature of the detonation gas via the heat sink.

28. The method of claim 27, further including the steps of:

providing a compression section in functional connection with the perforating gun; and further reducing the pressure of the detonation gas via the compression section.

29. The method of claim 28 wherein the compression section includes a compressible spring.

30. The method of claim 28 wherein the compression section includes a compressible fluid.

31. The method of claim 28 wherein the compression section includes a compressible solid.

32. The method of claim 27 wherein the heat sink includes copper.

33. The method of claim 27 wherein the heat sink includes water.

34. A method of reduce the post-detonation pressure of a perforating gun comprising the steps of:

providing the perforating gun with explosive charges;

providing a reactant adapted for recombining with the detonation gas from detonation of the explosive charges to form solids;

detonation the explosive charges producing a pressurized detonation gas; and reducing the detonation gas pressure proximate the perforating gun, by recombining the detonation gas to form solid, to encourage a surge flow from a reservoir formation.

35. The method of claim 34 wherein the reactant is selected from the group consisting of Al, Ca, Li, Mg, Ta, Ti, Zr, and combinations thereof.

36. The method of claim 34, further including the steps of:

providing a heat sink in functional connection with the perforating gun; and further reducing the temperature of the detonation gas.

37. The method of claim 36, wherein the heat sink includes copper.

38. The method of claim 36, wherein the heat sink includes water.

39. The method of claim 36, wherein the heat sink includes microencapsulaced water beads.

* * * * *